US005214810A

United States Patent [19]

Ward

[11] Patent Number: 5,214,810

[45] Date of Patent: Jun. 1, 1993

[54] MATTRESS HANDLE CONSTRUCTION

[75] Inventor: James T. Ward, Yorba Linda, Calif.

[73] Assignee: Ther-A-Pedic Associates, Inc., Boca Raton, Fla.

[21] Appl. No.: 960,641

[22] Filed: Oct. 14, 1992

[51] Int. Cl.[5] ..... A47C 31/08

[52] U.S. Cl. ..... 5/466

[58] Field of Search ..... 5/466, 467

[56] References Cited

U.S. PATENT DOCUMENTS

| | | | |
|---|---|---|---|
| 2,021,238 | 11/1935 | Karr | 5/466 |
| 2,194,407 | 3/1940 | Rolstone | 5/466 |
| 2,224,301 | 12/1940 | Johnson . | |
| 2,322,995 | 6/1943 | Allen | 5/466 |
| 3,351,964 | 11/1967 | Anson . | |
| 3,590,405 | 7/1971 | Kerr | 5/466 |
| 3,995,337 | 12/1976 | Gershaw | 5/466 |

*Primary Examiner*—Alexander Grosz
*Attorney, Agent, or Firm*—Frank P. Presta

[57] ABSTRACT

A handle apparatus constructed for use with a mattress of the type having a frame assembly including coil springs and rod-like members extending through the coil springs enclosed in a fabric cover, and handle receiving grommets positioned in the cover. The handle apparatus includes a strap-like hand grippable member extending along an outer surface of the cover, the grippable member having a pair of end portions positioned adjacent a pair of grommets in the cover, respectively. Each end portion has secured thereto an elongate connecting member adapted to extend through an adjacent grommet, each of the connecting members having a connecting end portion which extends adjacent the coil springs. The connecting end portion includes a longitudinally extending slot therein and an opening which leads into said slot. The slot is partitioned into a receiving portion and a locking portion by a flexible and resilient finger member which extends substantially transversely across the slot, thereby enabling the rod-like member to be inserted through the opening into the slot receiving portion and past the finger member into the slot locking portion. The finger member is operable to prevent the rod-like member from moving back to the slot receiving portion, thereby securely connecting the connecting member to the rod-like member. The rod-like member preferably extends through intermediate turns of adjacent coil springs so that the strain applied to the mattress by lifting the same by the handle apparatus will be transmitted mainly to the springs to prevent damage to the mattress cover.

7 Claims, 1 Drawing Sheet

MATTRESS HANDLE CONSTRUCTION

BACKGROUND OF THE INVENTION

The present invention relates to a mattress handle construction and, more particularly, to a new and improved mattress handle of the type constructed to connect with springs or other wire-type supports within a mattress.

It has become customary in the manufacture of mattresses to provide a spring assembly enclosed with a fabric cover, and to provide the cover with handles to enable the mattress to be conveniently lifted, moved and turned. The spring assembly customarily includes vertically spaced, generally rectangular upper and lower frames to which spaced apart coil springs are attached to yieldingly hold the frames in spaced relation. The cover may also include pads for the springs. Strap-like handles are usually attached to the sidewalls of the cover with the use of grommets or the like.

Owing to the fact that mattress handles of this type of construction are only attached to the fabric cover, they often result in the fabric becoming stretched, deformed, or torn, and the handles becoming detached, thereby rendering them inoperative.

Therefore, there exists a need for a simple and inexpensive mattress handle construction which enables the handle to be more securely connected with the mattress so that the fabric will not be damaged and the handle will not become detached even over an extended period of use. The mattress handle construction of the present invention meets this need.

BRIEF DESCRIPTION OF THE RELATED ART

Various mattress handle constructions are known in the art as evidenced by the U.S. Pat. No. 2,224,301, to Johnson, Anson U.S. Pat. No. 3,351,964, Houston U.S. Pat. No. 3,590,405 and Gershaw U.S Pat. No. 3,995,337.

These patents disclose the feature of constructing the handles to connect with the internal spring or frame assembly to relieve the strain on the fabric cover. In particular, the '337 and the '405 patents disclose the feature of providing elongated connecting members which extend through grommets in the cover and are adapted to connect with the coil springs through the use of a connecting wire or rod which extends through corresponding turns of the springs. The connecting members include a rectangular shaped stem portion having an enlarged portion on its inner end with a longitudinal slot therein. An opening is provided on an upper side wall of the slot to permit the connecting wire or rod to be inserted through the opening into the slot, thereby forming a connection with the springs.

While these type of mattress handle constructions work satisfactorily in some instances, the connecting members are subject to becoming separated from the connecting wire and springs, which results in all of the strain again being applied only to the fabric cover. The possible separation is due to the existence of the opening in the upper sidewall of the slot. In addition, the known mattress handles have been relatively complex and expensive to manufacture.

The new and improved mattress handle construction of the present invention was developed to overcome the disadvantages of the known handle constructions hereinbefore described.

SUMMARY OF THE INVENTION

Accordingly, it is a primary object of the present invention to provide a simple, inexpensive and reliable mattress handle construction which enables the strain applied to the mattress when lifting by the handle to be transmitted mainly to the inner springs of the mattress, thereby preventing damage to the mattress cover.

Another object of the present invention is to provide a mattress handle which can easily be connected with the inner springs or other internal rod-like member of the mattress, and which will not become disconnected therefrom even over an extended period of use.

A more particular object of the invention is to provide a mattress handle apparatus including a strap-like hand grippable member having a pair of end portions, each positioned adjacent a grommet and having secured thereto an elongate connecting member adapted to extend through the grommet, the connecting member including a connecting end portion having a longitudinally extending slot therein and an opening which leads into the slot, the slot being partitioned into a receiving portion and a locking portion by a resilient finger member which extends generally transversely across the slot. The resilient finger member is adapted to enable a rod-like mattress member to be inserted through the opening into the slot receiving portion. The finger member into the slot locking portion, and further wherein the finger member prevents the rod-like member from returning back to the slot receiving portion, thereby securely retaining the rod-like member in the locking portion of the slot.

Another object of the invention is to provide a rod-like member which extends through intermediate turns of adjacent coil springs and substantially transverse to the connecting members, and further wherein the rod-like member extends through the locking portions of the slots of the handle connecting members, thereby securely connecting the connecting members to the inner coil springs.

DESCRIPTION OF THE DRAWING

Other objects and advantages of the subject invention will become apparent from a study of the following specification when viewed in light of the accompanying drawing, in which.

DETAILED DESCRIPTION

Figure 1:
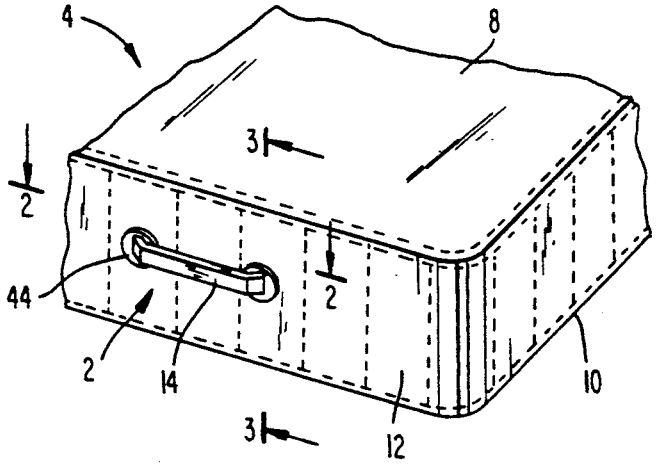
FIG. 1 is a partial perspective view of a mattress including the mattress handle constructed in accordance with the present invention.
Figure 3:
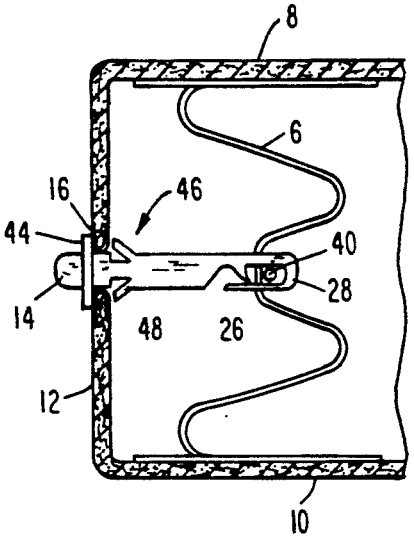
FIG. 3 is a sectional view of the mattress handle of the present invention taken substantially along line 3—3 of FIG. 1.
Figure 2:
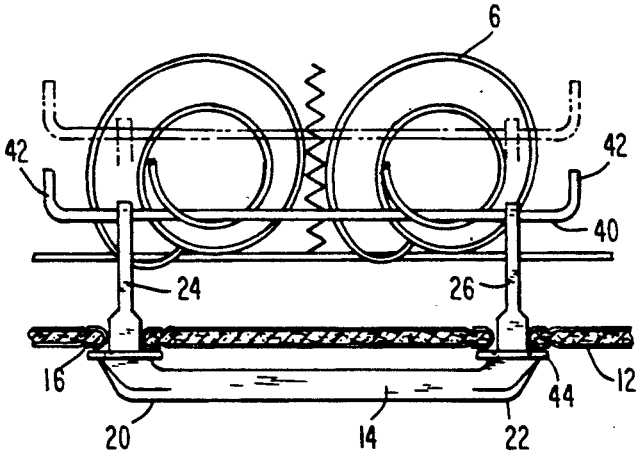
FIG. 2 is a sectional view of the mattress handle of the present invention taken substantially along line 2—2 of FIG. 1.
Figure 4:
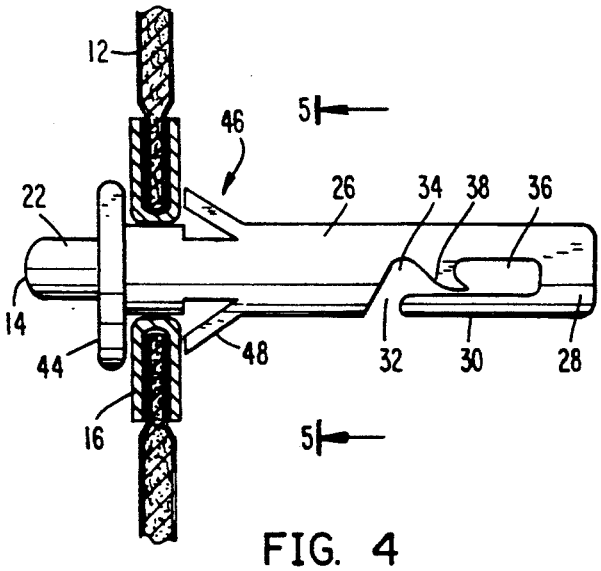
FIG. 4 is an enlarged elevational view, partly in section, of the mattress handle as illustrated in FIG. 3.
Figure 5:
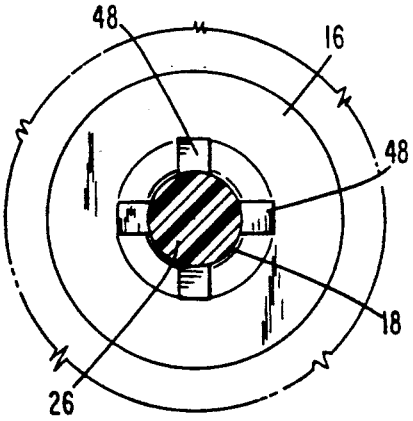
FIG. 5 is a sectional view of the mattress handle of the present invention taken along line 5—5 of FIG. 4.

Referring now to FIGS. 1-5, there is shown the mattress handle of the present invention which is generally designated by the numeral 2, and is shown in use on a bed spring or mattress 4 of the inner spring type, of usual construction, having coil springs 6 arranged in spaced relation between upper, lower and side fabric pads 8, 10 and 12, respectively, which define a mattress cover. The side portion 12 of the mattress cover has therein a plurality of handle receiving grommets 16 or the like of any suitable construction which provide openings 18 therein for receiving a handle intended for use in lifting the mattress.

The mattress handle 2 includes a strap-like hand grippable member 14 constructed to extend along the outer surface of the side cover portion 12, and having a pair of opposed end portions 20 and 22 each of which extend adjacent a grommet 16. Elongate connecting members 24 and 26 are secured to the grippable member end portions 20 and 22, respectively, and are constructed to fit through the grommets 16. The connecting members 24, 26 each include a connecting end portion 28 which when inserted through the grommet 16, extends to a position adjacent the inner coil spring assembly 6 of the mattress 4. The connecting end portion 28 includes a slot 30 therein and an opening 32 which leads into the slot 30. The slot 30 is partitioned into a receiving portion 34 and a locking portion 36 by a flexible and resilient finger member 38 which extends substantially transversely across the slot 30.

The slot 30, opening 32 and finger member 38 are constructed to enable a transverse rod-like member 40 within the mattress spring assembly to be inserted through the opening 32 into the receiving portion 34, and past the finger member 38 into the locking portion 36. The finger member 38 operates to prevent the rod-like member from returning back to the receiving portion 34 of the slot 30 once it is moved into the locking portion 36 past the finger member 38. Preferably, the opening 32 is positioned adjacent one end of the slot 30, and the finger member 38 is secured to a sidewall of the slot 30 and extends therefrom angularly away from the opening 32 to a position adjacent an opposing side wall of the slot, thereby enabling the rod-like member to enter but not exit the locking portion 36 of the slot 30.

Preferably, the rod-like member 40 extends through intermediate turns of adjacent springs 6 and substantially transverse to the connecting members 24 and 26, and is received in the locking portions 36 thereof, thereby securely connecting the handle 2 to the inner spring assembly. However, the connecting members 24 and 26 may be connected to any other suitable elongate member within the spring assembly, such as the spring itself, a border wire or the like. In accordance with the preferred embodiment of the invention, the rod-like member includes inwardly extending end portions 42 which are bent for engagement with the connecting members 24 and 26 to prevent longitudinal movement of the rod-like member 40 out of the slot 30.

In accordance with the invention, the rod-like member may be inserted at any suitable location in the inner spring assembly so that the connecting members are positioned to effectively connect the handle 2 to the spring assembly 6, and so that the strain applied to the mattress 4 by lifting the same by the handle 2 will be transmitted mostly to the inner spring assembly 6, thereby preventing tearing of the mattress cover side portion 12 or pulling out of the grommets 16.

Preferably, the end portions 20 and 22 of the hand grippable member 14 each include a head portion 44 which is constructed to fit against the outer surface of the grommet 16. The connecting members 24 and 26 preferably include resilient retaining means 46 extending laterally therefrom and shaped to enable the retaining means 46 to yieldingly contract to allow the connecting members 24 and 26 to pass through the grommet 16, and to expand once therethrough to a position in which the retaining means 46 contact an internal surface of the grommet 16, thereby retaining the grommet 16 between the head portion 44 and the retaining means 46. By providing the retaining means 46, the connecting members 24 and 26 are prevented from pulling back through the grommet 16 once inserted therein. Preferably, the retaining means 46 includes a plurality of spaced, radially extending, flexible and resilient retaining finger members 48.

Preferably, the handle 2, including all of the parts hereinbefore described, is integrally formed of a synthetic plastic material, but any other suitable material may be used.

The present invention as hereinbefore described provides a simple, inexpensive and reliable handle for a mattress which can easily be used with a conventional mattress to enable it to be lifted, moved and/or turned without damaging the fabric cover.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. A handle apparatus for use with a mattress of the type having a frame assembly including inner coil springs and rod-like members extending through the coil springs enclosed in a fabric cover, and handle receiving grommets positioned in the cover, said handle apparatus comprising a strap-like hand grippable member extending along an outer surface of said cover, said grippable member having a pair of end portions positioned adjacent a pair of grommets, respectively, each end portion having secured thereto an inwardly extending elongate connecting member adapted to extend through a grommet, each of said connecting members having an inner connecting end portion which extends adjacent the coil springs, said connecting end portion including a substantially longitudinally extending slot therein and an opening which leads into said slot and is positioned outwardly thereof, said slot being partitioned into a receiving portion and a locking portion by a flexible and resilient finger member which extends substantially transversely across said slot, whereby a rod-like member can be inserted through said opening into said slot receiving portion and past said finger member into said slot locking portion, and said finger member serving to prevent the rod-like member from moving back to said slot receiving portion once it has entered said locking portion, thereby securely connecting said connecting member to the rod-like member.

2. Apparatus as defined in claim 1, wherein said end portions of said grippable member each include a head portion which is adapted to abut against an outer surface of the grommet, and further wherein said connecting members each include resilient retaining means extending laterally outwardly therefrom and shaped to enable said retaining means to yieldingly contract to allow said connecting means to pass through the grommet and to expand to a position in which the retaining means contacts an inner surface of the grommet when said connecting members are inserted therein to engage and retain the grommet between said head portion and said retaining means.

3. Apparatus as defined in claim 2, wherein said grippable member and said connecting members are integrally formed of plastic material.

4. Apparatus as defined in claim 2, wherein said retaining means includes a plurality of spaced, radially extending, flexible and resilient retaining finger members.

5. Apparatus as defined in claim 1, wherein said opening is positioned adjacent the inner end of said slot and said finger member is secured to a side wall of said slot and extends therefrom angularly away from said opening to a position adjacent an opposing side wall of said slot, thereby enabling the rod-like member to enter but not exit the slot locking portion.

6. Apparatus as defined in claim 1, and further comprising a rod-like member extending through intermediate turns of adjacent ones of said coil springs and substantially transverse to said connecting members, and further wherein said rod-like member extends through said locking portions of said slots, thereby securely connecting said connecting members to said coil springs.

7. Apparatus as defined in claim 6, wherein said rod-like member has end portions which are shaped for engagement with said connecting members to prevent longitudinal movement of said rod-like member out of said slots.

* * * * *